US010705458B2

(12) United States Patent
Ikeda et al.

(10) Patent No.: US 10,705,458 B2
(45) Date of Patent: Jul. 7, 2020

(54) IMAGE FORMING APPARATUS THAT DIFFERS TONER USE WHEN FORMING A LINE IMAGE THAN WHEN FORMING A SOLID IMAGE

(71) Applicant: FUJI XEROX CO., LTD., Tokyo (JP)

(72) Inventors: Miho Ikeda, Kanagawa (JP); Aya Kakishima, Kanagawa (JP); Yasumitsu Harashima, Kanagawa (JP); Shinji Okuyama, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/946,182

(22) Filed: Apr. 5, 2018

(65) Prior Publication Data

US 2019/0086842 A1 Mar. 21, 2019

(30) Foreign Application Priority Data

Sep. 15, 2017 (JP) ..... 2017-178137

(51) Int. Cl.

| | |
|---|---|
| ***G03G 15/16*** | (2006.01) |
| ***G03G 15/01*** | (2006.01) |
| *G03G 15/20* | (2006.01) |
| *G03G 15/00* | (2006.01) |

(52) U.S. Cl.

CPC ..... *G03G 15/1615* (2013.01); *G03G 15/0131* (2013.01); *G03G 15/0189* (2013.01); *G03G 15/2064* (2013.01); *G03G 15/556* (2013.01); *G03G 2215/1623* (2013.01)

(58) Field of Classification Search

CPC ..... G03G 15/1615

USPC ..... 399/308

See application file for complete search history.

(56) References Cited

U.S. PATENT DOCUMENTS

| | | | | |
|---|---|---|---|---|
| 2003/0186148 | A1* | 10/2003 | Nakamura | G03G 9/08797 430/107.1 |
| 2009/0154946 | A1* | 6/2009 | Nakase | G03G 15/326 399/52 |
| 2010/0092215 | A1* | 4/2010 | Veregin | G03G 15/0126 399/223 |
| 2013/0164004 | A1* | 6/2013 | Ai | G03G 15/6585 399/40 |

FOREIGN PATENT DOCUMENTS

| | | |
|---|---|---|
| JP | 2002-328501 A | 11/2002 |
| JP | 2010-201357 A | 9/2010 |

* cited by examiner

*Primary Examiner* — Walter L Lindsay, Jr.
*Assistant Examiner* — Philipmarcus T Fadul
(74) *Attorney, Agent, or Firm* — Sughrue Mion, PLLC

(57) ABSTRACT

An image forming apparatus includes image forming units, a transfer unit that transfers a superposed toner image including toner images formed by the image forming units onto a sheet, a fixing unit that fixes the superposed toner image onto the sheet, and a controller that performs control such that a toner image is formed while the amount of toner used per unit area by the second image forming unit when forming a line image is smaller than that when forming a solid image. The image forming units include a first image forming unit that forms a toner image that is transferred onto the transfer unit relatively earlier than the other toner images and a second image forming unit that forms a toner image that is transferred onto the transfer unit relatively later than the other toner images, the first and second image forming units using the same color toner.

16 Claims, 5 Drawing Sheets

IMAGE FORMING APPARATUS THAT DIFFERS TONER USE WHEN FORMING A LINE IMAGE THAN WHEN FORMING A SOLID IMAGE

CROSS-REFERENCE TO RELATED APPLICATIONS

This application is based on and claims priority under 35 USC 119 from Japanese Patent Application No. 2017-178137 filed Sep. 15, 2017.

BACKGROUND

(i) Technical Field

The present invention relates to an image forming apparatus.

(ii) Related Art

When an image forming apparatus that includes plural image forming units each of which forms a monochromatic color toner image forms a superposed toner image that includes toner images of the same color such as, for example, white toner images superposed with each other by using a first image forming unit that is one of the plural image forming units and that forms a toner image relatively earlier than the other image forming units and a second image forming unit that is another one of the plural image forming units and that forms a toner image relatively later than the other image forming units, in the case where the superposed toner image is a line image, there is a possibility that toner scattering will occur at the time of transferring the superposed toner image.

SUMMARY

According to an aspect of the invention, there is provided an image forming apparatus including plural image forming units each of which forms a toner image based on image data, a transfer unit onto which plural toner images formed by the plural image forming units are sequentially transferred such that the plural toner images are superposed with one another and that transfers a superposed toner image formed as a result of the plural toner images being transferred to the transfer unit onto a sheet that is transported to the transfer unit, and a fixing unit that fixes a superposed toner image onto a sheet that has been further transported after the toner image has been transferred to the sheet. The plural image forming units include a first image forming unit configured to form a toner image that is included in a single superposed toner image and that is to be transferred to the transfer unit relatively earlier than toner images formed by the other image forming units and a second image forming unit configured to form a toner image that is included in the single superposed toner image and that is to be transferred to the transfer unit relatively later than the toner images formed by the other image forming units, the first image forming unit and the second image forming unit using the same color toner for forming the toner images. The image forming apparatus includes a controller that controls toner image formation in such a manner that, when a toner image that includes toner images of the same color superposed with each other is formed by using the first image forming unit and the second image forming unit, the toner image is formed under a condition where an amount of toner used per unit area by the second image forming unit in a case of forming a line image is smaller than an amount of toner used per unit area by the second image forming unit in a case of forming a solid image excluding the line image.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below.

Figure 1:
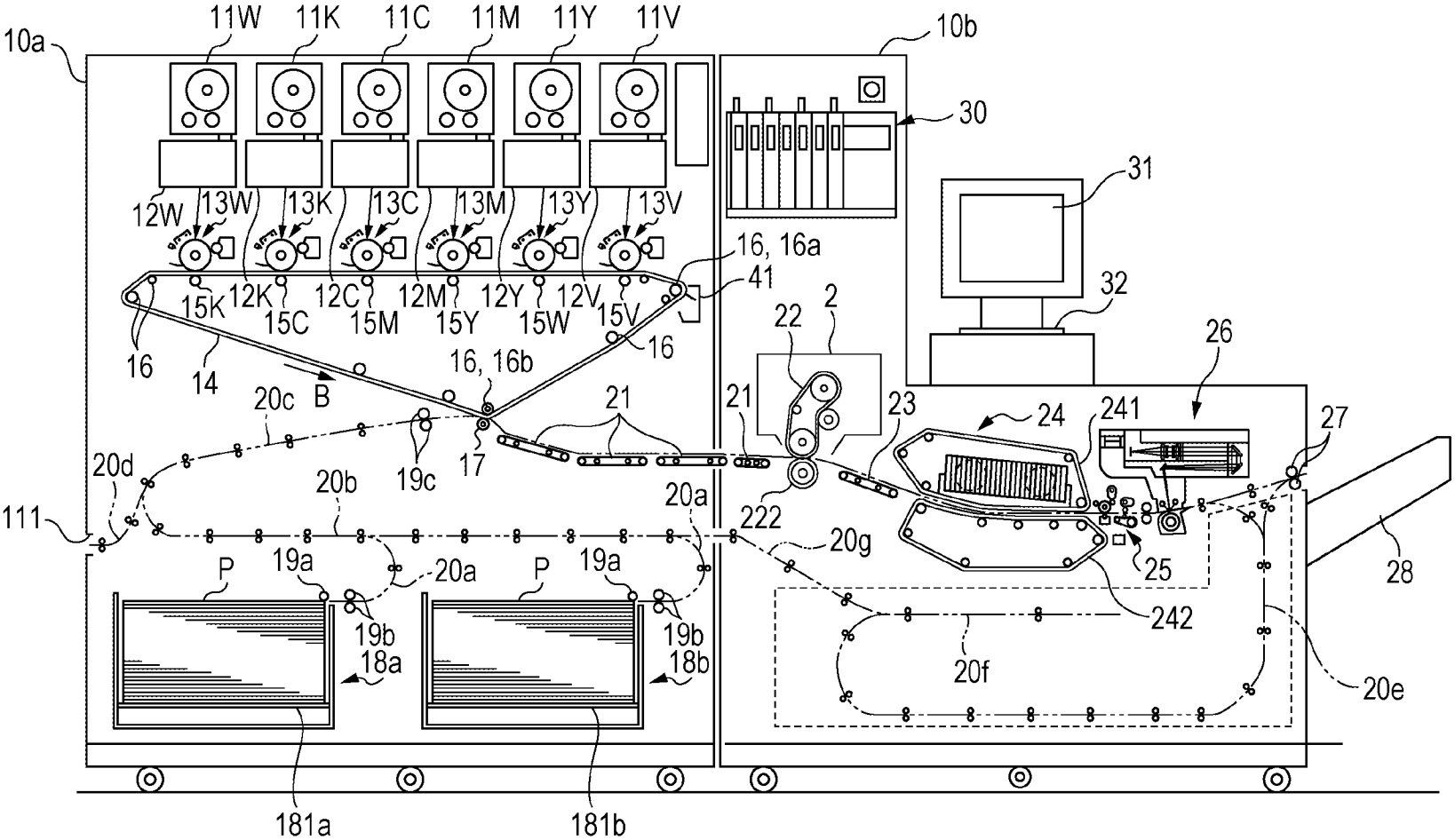
FIG. 1 is a diagram illustrating a schematic configuration of an image forming apparatus according to the exemplary embodiment of the present invention.

FIG. 1 is a diagram illustrating a schematic configuration of an image forming apparatus according to the present exemplary embodiment of the present invention.

An image forming apparatus 10 includes two housings that are a first housing 10*a* and a second housing 10*b* coupled to each other, and each member of the image forming apparatus 10 is incorporated in one of these two housings.

The image forming apparatus 10 is configured to form an image by using up to six color toners, and six toner cartridges 11V, 11Y, 11M, 11C, 11K and 11W each of which contains one of the six color toners are arranged in an upper portion of the first housing 10*a*.

Here, the characters included in the reference signs denote the colors of the toners contained in the toner cartridges, and the characters Y, M, C, and K respectively denote yellow, magenta, cyan and black. The characters V and W each denote a spot color other than Y, M, C, K, and in the present exemplary embodiment, toner cartridges that contain the same color toner, which is white toner, are used as the toner cartridges 11V and 11W.

In the following description, the reference characters denoting the toner colors will be omitted when it is not necessary to distinguish the toner cartridges in accordance with the toner colors, and the toner cartridges will be simply called the toner cartridges 11. When it is necessary to distinguish the toner cartridges in accordance with the toner colors, the toner cartridges will be denoted by the reference numerals with the above-mentioned characters denoting the toner colors. The same applies to the components other than the toner cartridges 11.

The toners in the toner cartridges 11 are supplied to image forming units 13 that will be described later. The toner cartridges 11 are replaceable, and when each of the toner cartridges 11 is empty, the toner cartridge 11 is replaced with a new toner cartridge 11 that contains color toner the same as that contained in the toner cartridge 11.

In the first housing 10*a*, six exposure units 12 and the six image forming units 13 are disposed below the toner cartridges 11, each of the six exposure units 12 and each of the six image forming units 13 corresponding to one of the six toner cartridges 11.

Figure 2:
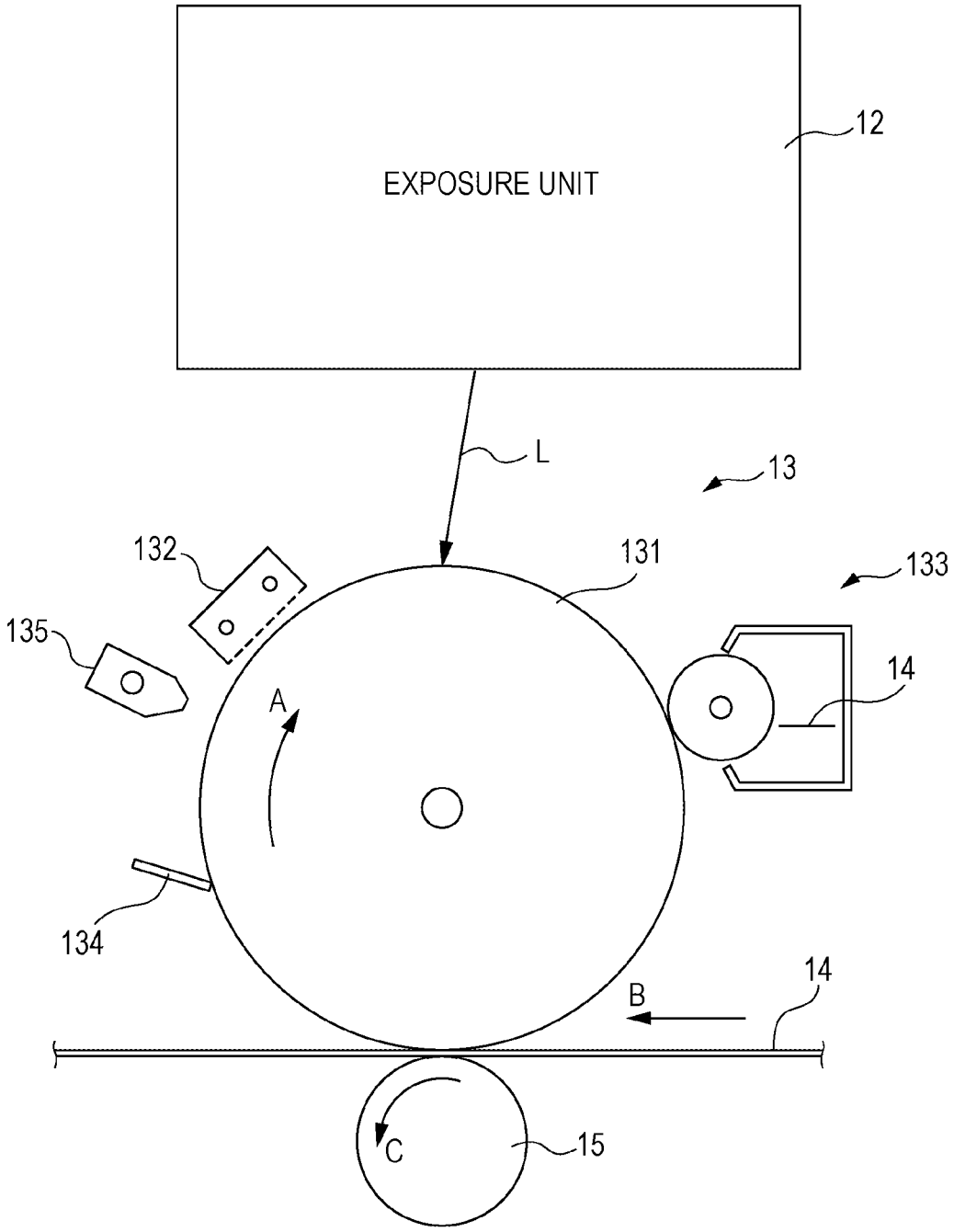
FIG. 2 is a schematic diagram illustrating a peripheral configuration of one of six image forming units.

FIG. 2 is a schematic diagram illustrating the peripheral configuration of one of the image forming units.

The image forming unit 13 includes a corresponding one of drum-shaped photoconductors 131 that rotates in the direction of arrow A, and a corresponding one of charger 132, a corresponding one of developing unit 133, a corresponding one of cleaning blade 134, and a corresponding one of static eliminator 135 are disposed around the photoconductor 131. In addition, a corresponding one of the above-mentioned exposure units 12 is disposed above the photoconductor 131, and a corresponding one of first transfer rollers 15 is disposed in such a manner that an intermediate transfer belt 14, which will be described later, is interposed between the photoconductor 131 and the first transfer roller 15.

The photoconductor 131 is charged by the charger 132 and exposed to an exposure beam L radiated from the exposure unit 12 while the photoconductor 131 is rotating in the direction of arrow A. The exposure unit 12 causes the exposure beam L that has been modulated in accordance with image data to repeatedly scan the photoconductor 131 in the direction perpendicular to FIG. 2, and as a result of the exposure beam L repeatedly scanning the photoconductor 131, an electrostatic latent image is formed onto the photoconductor 131. The electrostatic latent image is developed by the developing unit 133, which contains a developer including a toner and a carrier, with the toner included in the developer, so that a toner image is formed onto the photoconductor 131. One of the toner cartridges 11 (see FIG. 1) that corresponds to the developing unit 133 supplies the toner to the developing unit 133 in such a manner that the developing unit 133 contains a predetermined amount of the toner. The toner image, which has been formed on the photoconductor 131 by operation of the developing unit 133, is transferred onto the intermediate transfer belt 14 that moves in the direction of arrow B by operation of the first transfer roller 15 that rotates in the direction of arrow C.

The toner that remains on the photoconductor 131 after the toner image has been transferred is scraped off from the photoconductor 131 and collected by the cleaning blade 134, and in addition, charges are removed from the photoconductor 131 by the static eliminator 135 such that a latent image remaining thereon is removed. Then, the photoconductor 131 is charged again by the charger 132.

FIG. 1 will be referred to again in the following description.

The intermediate transfer belt 14 having an endless loop shape is disposed below the six image forming units 13. The intermediate transfer belt 14 is supported by plural rollers 16 including a driving roller 16*a* and a backup roller 16*b* and moves circularly in the direction of arrow B while being in contact with the photoconductors 131, each of which is included in a corresponding one of the image forming units 13.

A second transfer roller 17 is disposed at a position facing the backup roller 16*b* with the intermediate transfer belt 14 interposed between the second transfer roller 17 and the backup roller 16*b*. Toner images that have been sequentially transferred to the intermediate transfer belt 14 in such a manner as to be superposed with one another by operation of the first transfer rollers 15, each of which is disposed so as to correspond to one of the image forming units 13, are further transported by the intermediate transfer belt 14 in the direction of arrow B. The toner images on the intermediate transfer belt 14 are transferred, by operation of the second transfer roller 17, in a second transfer process onto a sheet that is transported to a position between the intermediate transfer belt 14 and the second transfer roller 17. As a result, unfixed toner images are formed on the sheet.

Two sheet-accommodating units 18*a* and 18*b* are disposed in a lower portion of the first housing 10*a*, and a large number of sheets P are accommodated and stacked on top of one another in each of the sheet-accommodating units 18*a* and 18*b*. When image formation is performed, the sheets P are taken out from the sheet-accommodating units 18*a* and 18*b*. As the number of the sheets P accommodated in the sheet-accommodating unit 18*a* decreases, a bottom plate 181*a* moves upward, and as the number of the sheets P accommodated in the sheet-accommodating unit 18*b* decreases, a bottom plate 181*b* moves upward.

When image formation is performed, one of the sheets P accommodated in one of the sheet-accommodating units 18*a* and 18*b* that is manually specified by an operator or automatically specified, the sheet P being at the top of the accommodated sheets P, is taken out by a corresponding one of pickup rollers 19*a*. When some of the sheets P are taken out at a time, a corresponding pair of separation rollers 19*b* separate the sheets P one by one with certainty, and one of the separated sheets P is transported to transport paths 20*a*, 20*b*, and 20*c* by transport rollers 19 such that an end of the sheet P reaches positioning rollers 19*c*. The first housing 10*a* has a feed port 111 through which a sheet is fed from outside the first housing 10*a*, and when a sheet is fed through the feed port 111, the sheet is transported along a transport path 20*d* and the transport path 20*c* such that an end of the sheet reaches the positioning rollers 19*c*. The positioning rollers 19*c* serve to correct the position of a sheet that is transported thereto, to adjust the timing of subsequent transportation of the sheet, and to send out the sheet toward the downstream side in a transport direction.

The positioning rollers 19*c* send out one of the sheets P in such a manner that the sheet P is transported to the position of the second transfer roller 17 in accordance with the timing at which the toner images on the intermediate transfer belt 14 are transported to the position of the second transfer roller 17.

The sheet P to which the toner images have been transferred by operation of the second transfer roller 17 is transported by transport belts 21 so as to enter the second housing 10*b* and reaches a fixing unit 22. The fixing unit 22 includes a heating belt 221 and a pressure roller 222, and the sheet P that has been transported to the fixing unit 22 is heated and pressurized while being nipped between the heating belt 221 and the pressure roller 222, so that the toner images on the sheet P are fixed to the sheet P. The sheet P that has passed through the fixing unit 22 is cooled by a cooling unit 24. The cooling unit 24 is configured to cool a sheet by nipping the sheet between two endless belts 241 and 242. After the sheet P has exited from the cooling unit 24, the curvature of the sheet P is corrected by a decurler 25, and an optical measuring unit 26 measures an image that is formed of the toner images fixed on the sheet P. When general image formation is performed, the optical measuring unit 26 performs monitoring so as to determine, for example, whether an image has been correctly formed on a sheet. In addition, when adjustments are performed, the optical measuring unit 26 also serves to perform measurements for various adjustments. The various adjustments include color tone correction, which is performed by arranging various charts such as, for example, various color patches onto a sheet by using the image forming apparatus 10 and measuring the colors of the color patches, and adjustments of image-formation position and image magnification, which are performed by forming an image for adjusting an image-formation position and an image for adjusting an image magnification onto a sheet and measuring the image. Furthermore, an image having a uniform color and a uniform density is formed onto a sheet by the image forming apparatus 10, and the optical measuring unit 26 measures the image so as to determine whether there is no scratch on the image and whether there is no variation in the density of the image.

The sheet P that has passed through the optical measuring unit 26 is ejected to a sheet-ejection tray 28 by sheet-ejection rollers 27.

Meanwhile, the intermediate transfer belt 14 moves in the direction of arrow B even after the toner images have been transferred in the second transfer process to the sheet P by operation of the second transfer roller 17, and toner remaining on the intermediate transfer belt 14 is removed from the intermediate transfer belt 14 by a cleaner 41.

Although the above-described process is a process for forming an image on only one surface of a sheet, in the case of forming images on the two surfaces of a sheet, the following process is performed. In this case, an image is formed on a first surface of a sheet through a process the same as the above-described process, and the sheet passes through the optical measuring unit 26. The sheet that has passed through the optical measuring unit 26 enters a transport path 20*e* before reaching the sheet-ejection rollers 27 and is transported along the transport path 20*e* so as to enter a transport path 20*f*. When the sheet enters the transport path 20*f*, the direction of rotation of transport rollers disposed on the transport path 20*f* is reversed, and the sheet is sent out from the transport path 20*f* in a reverse direction and transported back to the first housing 10*a*. Then, the sheet is transported along the transport paths 20*b* and 20*c* and reaches the positioning rollers 19*c*. The sheet in this state is in a position in which a second surface of the sheet on which no image has been formed faces the intermediate transfer belt 14. During the period when the sheet is passing through these transport paths so as to reach the positioning rollers 19*c*, the image forming units 13 form toner images that forms an image to be formed on the second surface of the sheet, and the toner images are transferred onto the intermediate transfer belt 14. After that, in a manner similar to the image formation performed on the first surface of the sheet, the positioning rollers 19*c* send out the sheet, and the toner images are transferred onto the second surface of the sheet by operation of the second transfer roller 17. Then, the sheet passes through the fixing unit 22, the cooling unit 24, the decurler 25, and the optical measuring unit 26 and is ejected this time to the sheet-ejection tray 28 by the sheet-ejection rollers 27.

An image-processing-and-control unit 30 is disposed in an upper portion of the second housing 10*b* of the image forming apparatus 10. The image-processing-and-control unit 30 includes a memory that stores image data transmitted from the outside, an operation circuit that performs various processing including image processing on the image data, and a control circuit that performs overall control of the image forming apparatus 10. The image-processing-and-control unit 30 corresponds to an example of a determining unit according to the present invention and to an example of a controller according to the present invention.

A monitor 31 that displays various states of the image forming apparatus 10 and an operation panel 32 that receives an operation from an operator are arranged so as to be placed on a portion of the second housing 10*b* that is smaller in height than the other portions of the second housing 10*b*.

Figure 3:
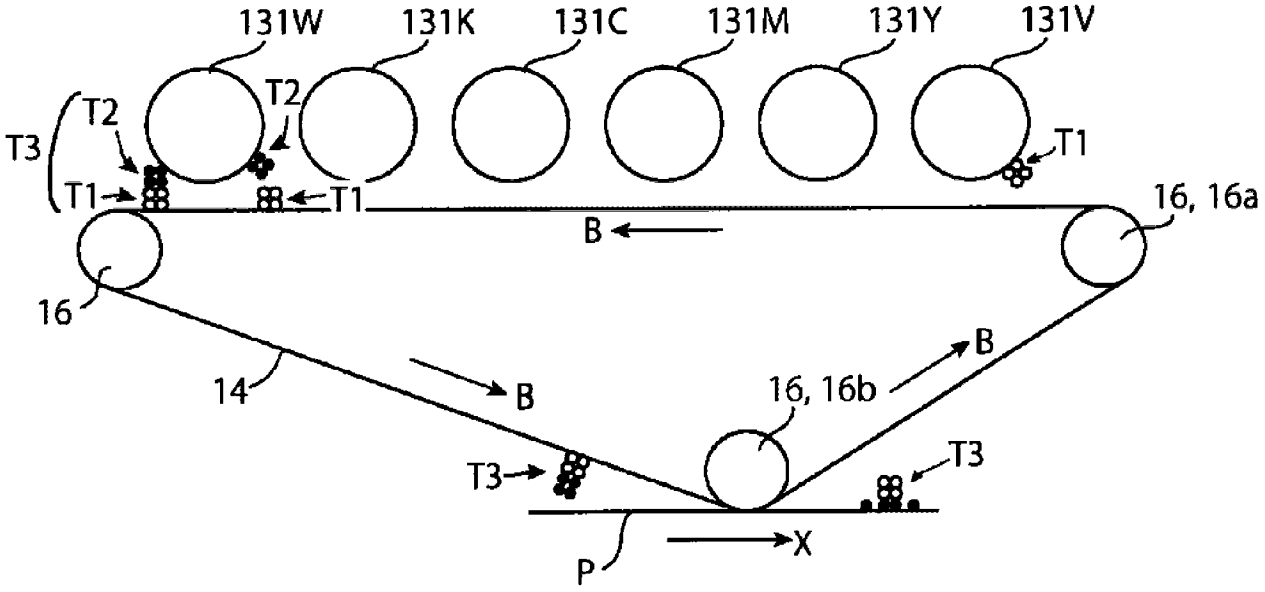
FIG. 3 is a schematic diagram illustrating the six image forming units (represented by six photoconductors thereof) and an intermediate transfer belt that are included in the image forming apparatus illustrated in FIG. 1 and FIG. 2.

FIG. 3 is a schematic diagram illustrating the six image forming units (represented by the six photoconductors thereof) and the intermediate transfer belt that are included in the image forming apparatus illustrated in FIG. 1 and FIG. 2. A problem that may be addressed by the image forming apparatus 10 according to the present exemplary embodiment will now be described with reference to FIG. 3.

As described above, in the image forming apparatus 10 according to the present exemplary embodiment, each of the photoconductor 131V and the photoconductor 131W forms a white toner image. In a direction in which toner images are sequentially transferred onto the intermediate transfer belt 14, the photoconductor 131V is located on the most upstream side and will hereinafter be referred to as the most upstream photoconductor 131V, and the photoconductor 131W is located on the most downstream side and will hereinafter be referred to as the most downstream photoconductor 131W.

The average particle diameter of each of the toners of the colors Y, M, C, and K is set to about 5 μm as an example, whereas the average particle diameter of the white toner is set to about 10 μm, which is large, as an example. Particle diameter of toner refers to the diameter of a circle having the same area as the projected area of toner when the toner is projected on a two-dimensional plane.

Since the average particle diameter of the white toner is large, when toner images are formed on the most upstream photoconductor 131V and the most downstream photoconductor 131W by using the white toner, the toner thickness is likely to be large. Accordingly, when a line image is formed by using the white toner, because a line image is an image having a small width, and also because a toner image formed of the white toner has a large thickness, toner scattering is more likely to occur compared with the case of using the other color toners.

FIG. 3 schematically illustrates the above-mentioned toner scattering phenomenon.

Here, toner images are formed by using the white toner onto the most upstream photoconductor 131V and the most downstream photoconductor 131W. A toner image T1 is formed onto the most upstream photoconductor 131V, and a toner image T2 is formed onto the most downstream photoconductor 131W, the toner image T1 having a toner thickness corresponding to half of the toner thickness of a line image that is eventually formed of the white toner, the toner image T2 having a toner thickness corresponding to the other half of the toner thickness of the line image. Then, a superposed toner image T3 that includes the toner images T1 and T2 superposed with each other is formed onto the intermediate transfer belt 14. The superposed toner image T3 is transferred onto one of the sheets P that is transported. There is a possibility that toner scattering will occur when the superposed toner image T3 is transferred onto the sheet P, which in turn results in formation of a defective image.

Figure 4:
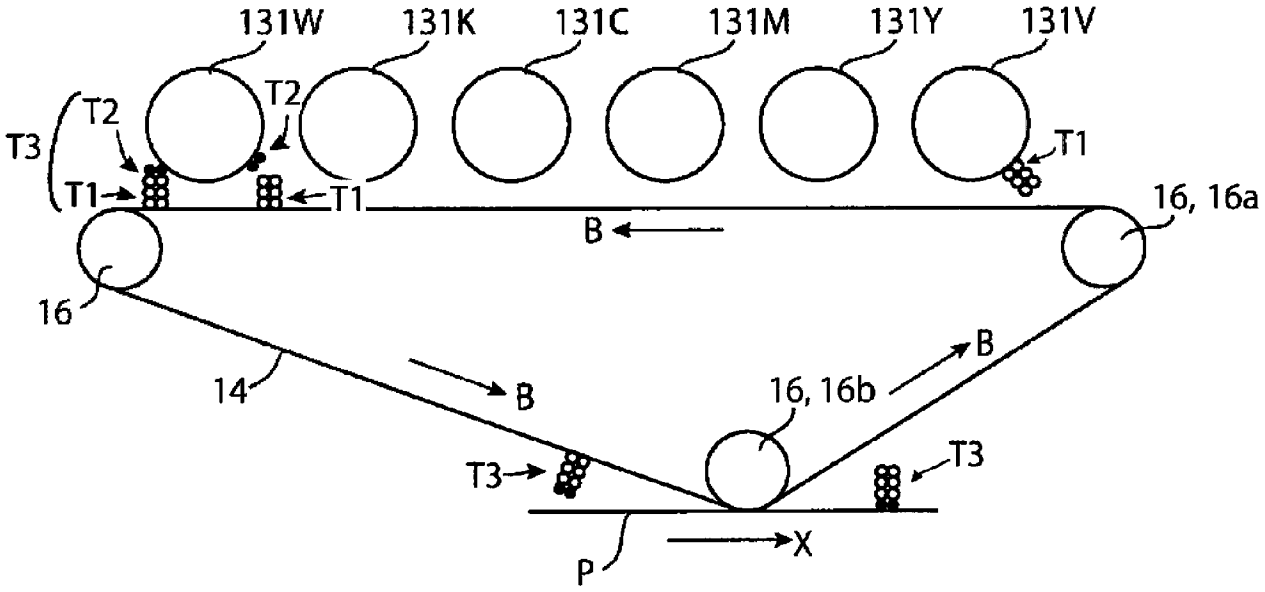
FIG. 4 is a schematic diagram illustrating, in a manner similar to FIG. 3, the six image forming units (also represented by the six photoconductors thereof) and the intermediate transfer belt that are included in the image forming apparatus illustrated in FIG. 1 and FIG. 2.

FIG. 4 is a schematic diagram illustrating, in a manner similar to FIG. 3, the six image forming units (also represented by the six photoconductors thereof) and the intermediate transfer belt that are included in the image forming apparatus illustrated in FIG. 1 and FIG. 2.

An exemplary measure to address the problem illustrated in FIG. 3 in the present exemplary embodiment will now be described with reference to FIG. 4.

Here, the superposed toner image T3, which includes formed of the toner images T1 and T2 superposed with each other, has a toner thickness that is the sum of the toner thickness of the toner image T1 formed on the most upstream photoconductor 131V and the toner thickness of the toner image T2 formed on the most downstream photoconductor 131W, and as an example, this toner thickness of the superposed toner image T3 is the same as the toner thickness of the superposed toner image T3 in the case illustrated in FIG. 3. The toner thickness of the toner image T1 formed on the most upstream photoconductor 131V is increased, and the toner thickness of the toner image T2 formed on the most downstream photoconductor 131W is decreased by an amount equal to the amount by which the toner thickness of the toner image T1 is increased. As a result, the probability of the occurrence of toner scattering when the superposed toner image T3 is transferred onto one of the sheets P is reduced even though the superposed toner image T3 that is transferred onto the sheet P has a toner thickness the same as that in the case illustrated in FIG. 3.

The toner image T1 that has been formed on the most upstream photoconductor 131V and transferred to the intermediate transfer belt 14 is transported by the intermediate transfer belt 14, and before the toner image T1 reaches the most downstream photoconductor 131W, the charge amount of the toner image T1 is increased by discharge of the photoconductors 131Y, 131M, 131C, and 131K, which are disposed between the most upstream photoconductor 131V and the most downstream photoconductor 131W, in a first transfer process. Thus, the toner image T1 formed on the most upstream photoconductor 131V is less likely to be scattered at the time of being transferred onto the sheet P. In contrast, the toner image T2 that has been formed on the most downstream photoconductor 131W and transferred to the intermediate transfer belt 14 is likely to be scattered at the time of being transferred onto the sheet P. In order to suppress this toner scattering, it is effective to reduce the toner thickness of the toner image T2 that is formed onto the most downstream photoconductor 131W.

Figure 5:
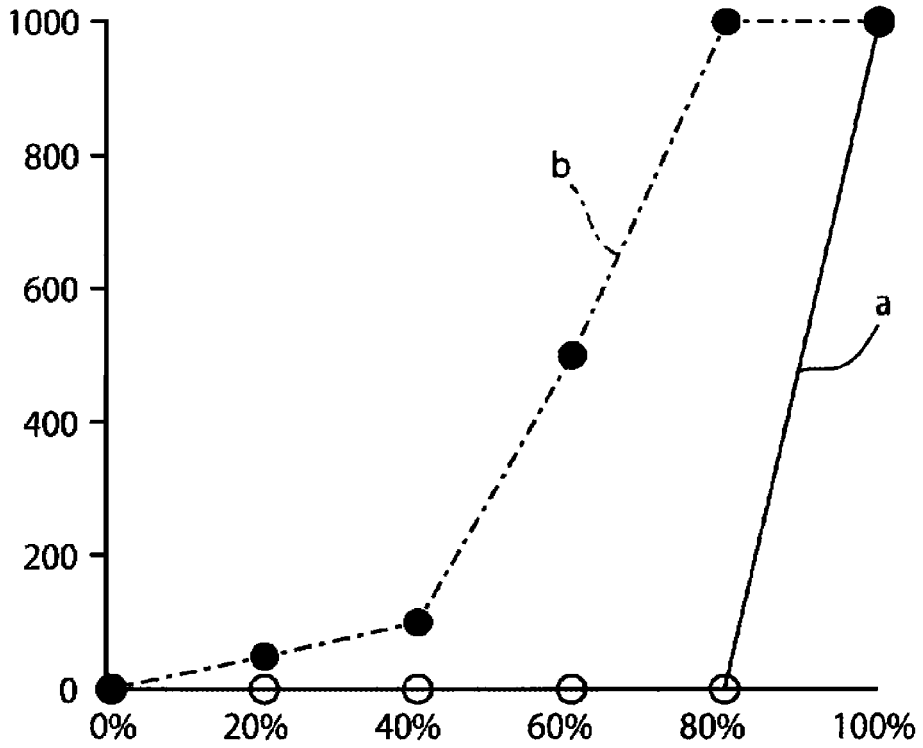
FIG. 5 is a graph illustrating the numbers of toner spots when the area coverage of a toner image formed by using the most upstream photoconductor or the most downstream photoconductor is varied.

FIG. 5 is a graph illustrating the numbers of toner spots when the area coverage of a toner image formed by using the most upstream photoconductor or the most downstream photoconductor is varied.

In the graph illustrated in FIG. 5, the line a connecting white dots indicates the numbers of toner spots when the area coverage of the toner image formed by using the most downstream photoconductor 131W is varied in the range of 0% to 100%, whereas the area coverage of the toner image formed by using the most upstream photoconductor 131V is fixed to 100%. The line b connecting black dots indicates the numbers of toner spots when the area coverage of the toner image formed by using the most upstream photoconductor 131V is varied in the range of 0% to 100%, whereas the area coverage of the toner image formed by using the most downstream photoconductor 131W is fixed to 100%.

Figure 6:
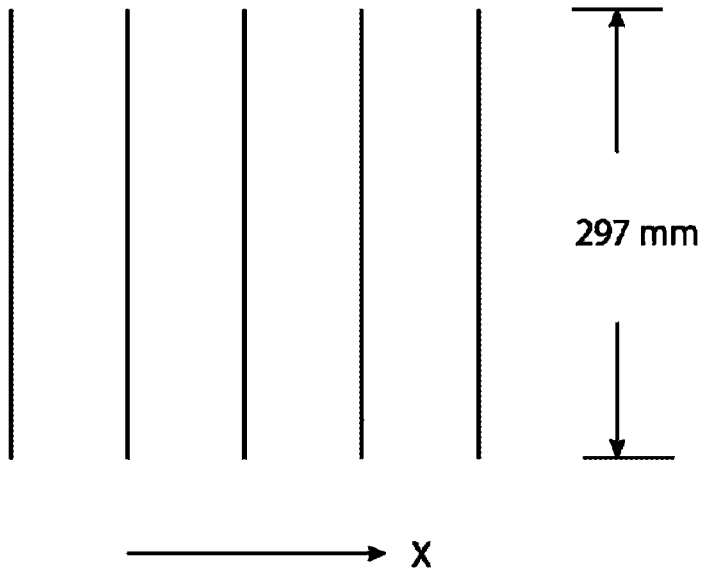
FIG. 6 is a schematic diagram illustrating experimental conditions under which the data illustrated in FIG. 5 is obtained.

FIG. 6 is a schematic diagram illustrating experimental conditions under which the data illustrated in FIG. 5 is obtained.

A line image formed of five straight lines each of which extends in a direction perpendicular to a sheet-transport direction X and each of which has a length of 297 mm is formed on each of the most upstream photoconductor 131V and the most downstream photoconductor 131W, and a superposed toner image that is formed by superposing the line images one on top of the other on the intermediate transfer belt 14 is transferred to one of the sheets P. Then, the number of toner spots formed on the sheet P as a result of transferring the line images onto the sheet P is counted.

In FIG. 5, the vertical axis denotes the number of toner spots. The horizontal axis denotes the area coverage of one of toner images, each of which is formed on the most upstream photoconductor 131V or the most downstream photoconductor 131W, the area coverage of the one being varied.

As illustrated in FIG. 5, in the case where the area coverage of the toner image that is formed on the most upstream photoconductor 131V is varied, no toner scattering is observed when the area coverage is 80% or lower. In contrast, in the case where the area coverage of the toner image that is formed on the most downstream photoconductor 131W is varied, toner scattering has already been observed when the area coverage is 40%, and the number of toner spots suddenly increases when the area coverage exceeds 40%. It is understood from the above data that, in order to suppress toner scattering in the case of line images that are formed so as to have the same toner thickness, it is more effective to reduce the toner thickness of the toner image that is formed onto the most downstream photoconductor 131W than to reduce the toner thickness of the toner image that is formed onto the most upstream photoconductor 131V.

Although the data illustrated in FIG. 5 is an example, the number of toner spots is more likely to increase as the line width of the line image illustrated in FIG. 6 becomes narrower, and the number of toner spots is more likely to decrease as the line width becomes wider.

In addition, the line image illustrated in FIG. 6 includes straight lines each extending in a direction perpendicular to the sheet-transport direction X, if the straight lines are inclined, the number of toner spots is more likely to decrease as the inclination angle of each of the straight lines with respect to the sheet-transport direction X becomes smaller such that the straight lines become more parallel to the sheet-transport direction X. That is to say, this indicates that the number of toner spots is more likely to increase as the line width measured in the sheet-transport direction X becomes narrower and that the number of toner spots is more likely to decrease as the line width measured in the sheet-transport direction X becomes wider.

By taking the above experimental data and knowledge into consideration, the image forming apparatus 10 according to the present exemplary embodiment, which is illustrated in FIG. 1, has the following configuration.

Although an explanatory note for each matter will be omitted, another situation will now be described in which a toner image that includes white toner images superposed with each other is formed by using the most upstream photoconductor 131V and the most downstream photoconductor 131W.

Image data that is transmitted from the outside is temporarily stored in the image-processing-and-control unit 30. Then, the image-processing-and-control unit 30 determines whether the transmitted image data is image data instructing formation of a toner image that includes white toner images, which are formed by using the most upstream photoconductor 131V and the most downstream photoconductor 131W and which are superposed with each other, and that includes a line image. When a toner image that includes white toner images superposed with each other is formed by using the most upstream photoconductor 131V and the most downstream photoconductor 131W, the image-processing-and-control unit 30 controls toner image formation such that a toner image is formed under the condition where the amount of toner used per unit area by the most downstream photoconductor 131W in the case of forming a line image is smaller than the amount of toner used per unit area by the most downstream photoconductor 131W in the case of forming a solid image excluding a line image. As described above, the average particle diameter of the white toner used in the present exemplary embodiment is larger than that of each of the other color toners. In the present exemplary embodiment, the amount of the white toner, whose average particle diameter is large, to be used is adjusted, that is, adjustment of the amount of toner usage is performed in accordance with the average particle diameter of toner.

In the image forming apparatus 10 according to the present exemplary embodiment, an image that has a width less than a predetermined threshold and that extends in a direction crossing the width direction thereof is determined to be a line image. In contrast, an image that does not meet the above criteria for a line image is determined to be a solid image. In this manner, in the present exemplary embodiment, it is determined whether image data represents a line image by analyzing the image data and determining the line width of a character or a figure.

In addition, in the present exemplary embodiment, a line image and a solid image are distinguished from each other by comparing the line width of a character or a figure in a sheet-transport direction and the threshold.

Furthermore, in the present exemplary embodiment, when a line image is formed, toner image formation is controlled in accordance with the width of the line image such that a toner image is formed under the condition where the amount of toner used per unit area by the most downstream photoconductor 131W decreases as the width becomes smaller.

Note that, in the present exemplary embodiment, although it is determined whether image data represents a line image by analyzing the image data and determining the line width of a character or a figure, image data may be considered to represent a line image depending on whether the image data is character data representing a character. The amount of calculation in this case is smaller than that in the case of analyzing image data and determining the line width of a character or a figure. Alternatively, a process of analyzing image data and determining the line width of a character or a figure and a process of considering character data to represent a line image may both be performed.

As described above, in the present exemplary embodiment, a method of adjusting image data is employed as a method of adjusting the amount of toner usage. In other words, in the present exemplary embodiment, by adjusting image data, a toner image is formed under the condition where the amount of toner used per unit area by the most downstream photoconductor 131W in the case of forming a line image is smaller than the amount of toner used per unit area by the most downstream photoconductor 131W in the case of forming a solid image. In this case, in the present exemplary embodiment, by forming a toner image on the basis of image data that represents an image having an area coverage less than the area coverage specified by image data that represents a line image and that is received from the outside, a toner image is formed under the condition where the amount of toner used per unit area by the most downstream photoconductor 131W in the case of forming a line image is smaller than the amount of toner used per unit area by the most downstream photoconductor 131W in the case of forming a solid image. As described above, in the present exemplary embodiment, since a method of adjusting the amount of toner usage by adjusting image data is employed, the amount of toner usage is adjusted without changing toner-image formation conditions (described later).

In the present exemplary embodiment, when adjusting the amount of toner usage by adjusting image data, toner image formation is controlled such that a toner image is formed under the condition where the amount of toner used per unit area by the most upstream photoconductor 131V in the case of forming a line image is larger than the amount of toner used per unit area by the most upstream photoconductor 131V in the case of forming a solid image. As a result, reduction in the amount of toner used for forming a line image is suppressed, whereas in the case where the amount of toner used per unit area by the most upstream photoconductor 131V in the case of forming a line image is the same as the amount of toner used per unit area by the most upstream photoconductor 131V in the case of forming a solid image, reduction in the amount of toner used for forming a line image is not suppressed.

More specifically, in the present exemplary embodiment, toner image formation is controlled such that the amount of the white toner used per unit area in a superposed toner image, which is transferred onto one of the sheets P, in the case of forming a solid image is the same as the amount of the white toner used per unit area in a superposed toner image, which is transferred onto one of the sheets P, in the case of forming a line image. As a result, an image that is formed in the present exemplary embodiment is closer to the contents of an instruction from a user than another image is, the other image being formed under the condition where the amount of toner used per unit area in a solid image and the amount of toner used per unit area in a line image are different from each other.

As a method of adjusting the amount of toner usage, a method of adjusting toner-image formation conditions may be employed. In other words, when a toner image that includes white toner images superposed with each other is formed by using the most upstream photoconductor 131V and the most downstream photoconductor 131W, when the toner image includes a line image, a toner-image formation condition for the most upstream photoconductor 131V is set to be different from a toner-image formation condition for the most downstream photoconductor 131W such that the amount of toner used per unit area by the most downstream photoconductor 131W is smaller than the amount of toner used per unit area by the most upstream photoconductor 131V even if the white toner images that are formed by using the most upstream photoconductor 131V and the most downstream photoconductor 131W are toner images that are formed on the basis of the same image data.

Here, in order to "set the toner-image formation condition for the most upstream photoconductor 131V to be different from the toner-image formation condition for the most downstream photoconductor 131W such that the amount of toner used per unit area by the most downstream photoconductor 131W is smaller than the amount of toner used per unit area by the most upstream photoconductor 131V", for example, it is effective to change developing conditions such that the developing ability of the most downstream photoconductor 131W is degraded so as to be lower than the developing ability of the most upstream photoconductor 131V. Here, the term "developing ability" refers to an ability to develop an electrostatic latent image with toner that is supplied to a photoconductor from a developing roller when the potential difference between the electric potential of a portion of the photoconductor on which an image is formed and the electric potential of the developing roller is set to a fixed value. As a specific method of degrading the developing ability, an alternating-current (AC) voltage that is applied to the developing roller may be stepped down, or no AC voltage may be applied to the developing roller. Alternatively, the developing ability may be degraded by reducing the speed at which the developing roller rotates or by increasing a gap between the developing roller and the photoconductor. In the case of an image forming apparatus in which either or both of reducing the speed at which the developing roller rotates and increasing the gap between the developing roller and the photoconductor may be performed, the developing ability may be degraded by any practicable method among these methods.

As other methods of setting the toner-image formation conditions to be different from each other, for example, the charging voltage applied to the most upstream photoconductor 131V by the corresponding charger 132 and the charging voltage applied to the most downstream photoconductor 131W by the corresponding charger 132 may be set to be different from each other, or the intensity of exposure light that is radiated onto the most upstream photoconductor 131V by the corresponding exposure unit 12 and the intensity of exposure light that is radiated onto the most downstream photoconductor 131W by the corresponding exposure unit 12 may be set to be different from each other. In the case of an image forming apparatus in which these methods may be performed, the toner-image formation conditions may be changed by any practicable method among these methods.

In the case where the method of changing the toner-image formation conditions is employed, the amount of toner usage is adjusted without adjusting image data.

Note that, in the present exemplary embodiment, although the case has been described as an example in which, among the six photoconductors 131, which are arranged in a row, the most upstream photoconductor 131V and the most downstream photoconductor 131W use the white toner, the present invention may also be applied to a case where any two of the photoconductors 131 excluding the most upstream photoconductor 131V and the most downstream photoconductor 131W use the white toner and form toner images that are to be superposed with each other.

In addition, although the white toner has been described as an example in the present exemplary embodiment, the present invention may be widely applied to cases in which toner images that are to be superposed with each other are formed by using the same color toner that is not white toner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a plurality of image forming units each of which forms a toner image based on image data;

a transfer unit onto which a plurality of toner images formed by the plurality of image forming units are sequentially transferred such that the plurality of toner images are superposed with one another and that transfers a superposed toner image formed as a result of the plurality of toner images being transferred to the transfer unit onto a sheet that is transported to the transfer unit; and a fixing unit that fixes a superposed toner image onto a sheet that has been further transported after the toner image has been transferred to the sheet, wherein the plurality of image forming units include a first image forming unit configured to form a toner image that is included in a single superposed toner image and that is to be transferred to the transfer unit relatively earlier than toner images formed by the other image forming units and a second image forming unit configured to form a toner image that is included in the single superposed toner image and that is to be transferred to the transfer unit relatively later than the toner images formed by the other image forming units, the first image forming unit and the second image forming unit using the same color toner for forming the toner images, wherein the image forming apparatus includes a controller that controls toner image formation in such a manner that, when a toner image that includes toner images of the same color superposed with each other is formed by using the first image forming unit and the second image forming unit, the toner image is formed under a condition where an amount of toner used per unit area by the second image forming unit in a case of forming a line image is smaller than an amount of toner used per unit area by the second image forming unit in a case of forming a solid image excluding the line image, wherein the controller adjusts image data in such a manner that the toner image is formed under the condition where the amount of toner used per unit area by the second image forming unit in the case of forming the line image is smaller than the amount of toner used per unit area by the second image forming unit in the case of forming the solid image, and wherein the controller controls toner image formation in such a manner that the toner image is formed under a condition where an amount of toner used per unit area by the first image forming unit in a case of forming the line image is larger than an amount of toner used per unit area by the first image forming unit in a case of forming the solid image.

2. The image forming apparatus according to claim 1, wherein the controller causes the toner image based on the image data that represents an image having an area coverage less than a specified area coverage to be formed in such a manner that the toner image is formed under the condition where the amount of toner used per unit area by the second image forming unit in the case of forming the line image is smaller than the amount of toner used per unit area by the second image forming unit in the case of forming a solid image.

3. The image forming apparatus according to claim 1, wherein the controller controls toner image formation in the first image forming unit in such a manner that an amount of the same color toner used per unit area in a superposed toner image, which is transferred onto the sheet, in the case of forming the solid image is the same as the amount of the same color toner used per unit area in a superposed toner image, which is transferred onto the sheet, in the case of forming the line image.

4. The image forming apparatus according to claim 1, wherein the controller performs control in such a manner that an image that has a width less than a predetermined threshold and that extends in a direction crossing the width direction of the image is determined to be a line image.

5. The image forming apparatus according to claim 4, wherein the controller distinguishes the line image and the solid image from each other by comparing a width of an image to be formed in a sheet-transport direction and the threshold.

6. The image forming apparatus according to claim 1, wherein, when the line image is formed, the controller controls toner image formation in accordance with a width of the line image in such a manner that a toner image is formed under a condition where the amount of toner used per unit area by the second image forming unit decreases as the width becomes smaller.

7. The image forming apparatus according to claim 1, wherein the controller performs control while determining character data included in the image data to represent a line image.

8. The image forming apparatus according to claim 1, wherein the plurality of image forming units include at least one image forming unit other than the first image forming unit and the second image forming unit, the at least one image forming unit being a third image forming unit that forms a toner image by using a color toner excluding the same color toner, and wherein the same color toner is a toner having an average particle diameter larger than an average particle diameter of the toner used by the third image forming unit.

9. The image forming apparatus according to claim 8, wherein each of the first image forming unit and the second image forming unit forms a toner image by using white toner.

10. An image forming apparatus comprising:

a plurality of image forming units each of which forms a toner image based on image data;

a transfer unit onto which a plurality of toner images formed by the plurality of image forming units are sequentially transferred such that the plurality of toner images are superposed with one another and that transfers a superposed toner image formed as a result of the plurality of toner images being transferred to the transfer unit onto a sheet that is transported to the transfer unit; and a fixing unit that fixes a superposed toner image onto a sheet that has been further transported after the toner image has been transferred to the sheet, wherein the plurality of image forming units include a first image forming unit configured to form a toner image that is included in a single superposed toner image and that is to be transferred to the transfer unit relatively earlier than toner images formed, by the other image forming units and a second image forming unit configured to form a toner image that is included in the single superposed toner image and that is to be transferred to the transfer unit relatively later than the toner images formed by the other image forming units, the first image forming unit and the second image forming unit using the same color toner for forming the toner images, wherein the image forming apparatus includes a controller that causes, when a toner image that includes toner images of the same color superposed with each other and that includes a line image is formed by using the first image forming unit and the second image forming unit, a toner-image formation condition in the first image forming unit and a toner-image formation condition in the second image forming unit to be different from each other in such a manner that an amount of toner used per unit area by the second image forming unit is smaller than an amount of toner used per unit area by the first image forming unit even though a toner image formed by the first image forming unit and a toner image formed by the second image forming unit are formed based on the same image data, wherein the controller adjusts image data in such a manner that the toner image is formed under the condition where the amount of toner used per unit area by the second image forming unit in the case of forming the line image is smaller than the amount of toner used per unit area by the second image forming unit in the case of forming the solid image, and wherein the controller controls toner image formation in such a manner that the toner image is formed under a condition where an amount of toner used per unit area by the first image forming unit in a case of forming the line image is larger than an amount of toner used per unit area by the first image forming unit in a case of forming the solid image.

11. The image forming apparatus according to claim 10, wherein the controller performs control in such a manner that an image that has a width less than a predetermined threshold and that extends in a direction crossing the width direction of the image is determined to be a line image.

12. The image forming apparatus according to claim 11, wherein the controller distinguishes the line image and the solid image from each other by comparing a width of an, image to be formed in a sheet-transport direction and the threshold.

13. The image forming apparatus according to claim 10, wherein the controller performs control while determining character data included in the image data to represent a line image.

14. The image forming apparatus according to claim 10, wherein the plurality of image forming units include at least one image forming unit other than the first image forming unit and the second image forming unit, the at least one image forming unit being a third image forming unit that forms a toner image by using a color toner excluding the same color toner, and wherein the same color toner is a toner having an average particle diameter larger than an average particle diameter of the toner used by the third image forming unit.

15. The image forming apparatus according to claim 14, wherein each of the first image forming unit and the second image forming unit forms a toner image by using white toner.

16. An image forming apparatus comprising:

a plurality of image forming means each of which forms a toner image based on image data;

transfer means onto which a plurality of toner images formed by the plurality of image forming means are sequentially transferred such that the plurality of toner images are superposed with one another and that transfers a superposed toner image formed as a result of the plurality of toner images being transferred to the transfer means onto a sheet that is transported to the transfer means; and fixing means that fixes a superposed toner image onto a sheet that has been further transported after the toner image has been transferred to the sheet, wherein the plurality of image forming means include first image forming means configured to form a toner image that is included in a single superposed toner image and that is to be transferred to the transfer means relatively earlier than toner images formed by the other image forming means and second image forming means configured to form a toner image that is included in the single superposed toner image and that is to be transferred to the transfer means relatively later than the toner images formed by the other image forming means, the first image forming means and the second image forming means using the same color toner for forming the toner images, wherein the image forming apparatus includes control means that controls toner image formation in such a manner that, when a toner image that includes toner images of the same color superposed with each other is formed by using the first image forming means and the second image forming means, the toner image is formed under a condition where an amount of toner used per unit area by the second image forming means in a case of forming a line image is smaller than an amount of toner used per unit area by the second image forming means in a case of forming a solid image excluding the line image, wherein the control means adjusts image data in such a manner that the toner image is formed under the condition where the amount of toner used per unit area by the second image forming means in the case of forming the line image is smaller than the amount of toner used per unit area by the second image forming means in the case of forming the solid image, and wherein the control means controls toner image formation in such a manner that the toner image is formed under a condition where an amount of toner used per unit area by the first image forming means in a case of forming the line image is larger than an amount of toner used per unit area by the first image forming means in a case of forming the solid image.

* * * * *